United States Patent [19]

Nagamoto et al.

[11] Patent Number: 4,560,966

[45] Date of Patent: Dec. 24, 1985

[54] POLARIZED ELECTROMAGNET AND POLARIZED ELECTROMAGNETIC RELAY

[75] Inventors: Mitsuki Nagamoto, Mie; Ikuo Hashiya, Osaka, both of Japan

[73] Assignees: Matsushita Electric Works, Ltd., Japan; SDS-Relais AG, Fed. Rep. of Germany

[21] Appl. No.: 626,382

[22] Filed: Jun. 29, 1984

[30] Foreign Application Priority Data

Jun. 30, 1983 [JP] Japan ..... 58-102053[U]
Jun. 30, 1983 [JP] Japan ..... 58-102054[U]

[51] Int. Cl.[4] ..... H01H 51/72

[52] U.S. Cl. ..... 335/80; 335/81; 335/85

[58] Field of Search ..... 335/78, 79, 80, 81, 335/84, 85, 179, 180, 229, 230, 234

[56] References Cited

U.S. PATENT DOCUMENTS 4,142,166 2/1979 Arnoux ..... 335/81
4,191,937 3/1980 Koehler et al. ..... 335/79 X
4,451,808 5/1984 Koehler ..... 335/81

*Primary Examiner*—George Harris
*Attorney, Agent, or Firm*—Schwartz, Jeffery, Schwaab, Mack, Blumenthal & Evans

[57] ABSTRACT

A polarized electromagnet comprises a generally E-shaped yoke including a pair of outer legs and an intermediate leg therebetween, the three legs being interconnected by a base portion, and a coil wound about the intermediate leg. A generally U-shaped armature comprises a permanent magnet and two pole plates attached to both ends of the permanent magnet. The armature is so positioned that each pole plate extends between the intermediate leg and a respective one of the outer legs of the yoke. The armature may be fitted into a generally U-shaped resin member integrally molded with portions extending outwardly to opposite sides of the pole plates and slidable engaged in guide slots provided in the outer yoke legs. When used in an electromagnetic relay, these projecting portions form actuating members engaging movable contacts of the relay.

11 Claims, 19 Drawing Figures

POLARIZED ELECTROMAGNET AND POLARIZED ELECTROMAGNETIC RELAY

Figure 1:
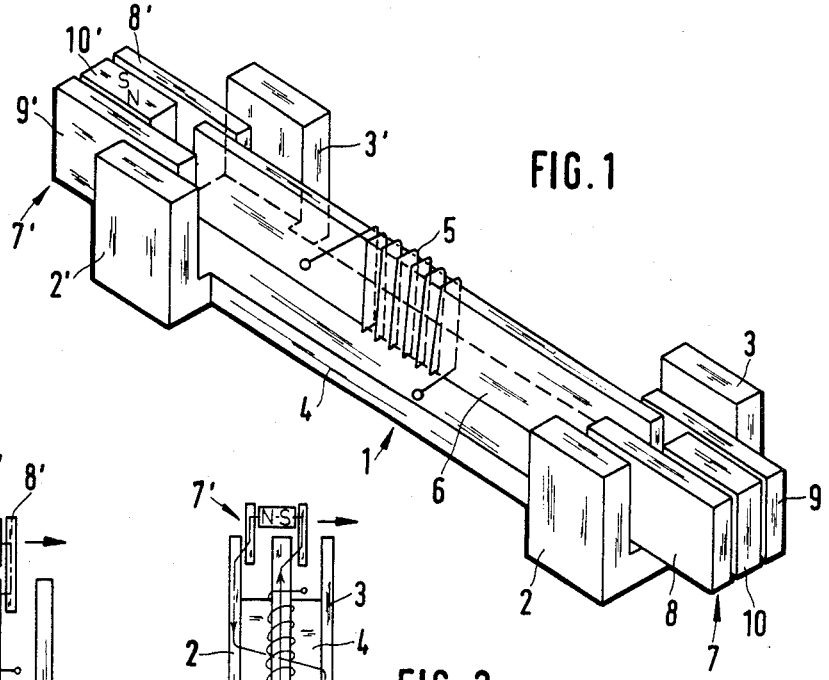

This invention relates to a polarized electromagnet and a relay using such electromagnet.

A conventional polarized electromagnet comprises a stationary yoke with a coil wound around a part of the yoke, and an armature including a permanent magnet and hinged to the yoke for pivotal movement in response to the energization of the coil. Mechanical and magnetic stability requires a certain minimum dimension of the hinge portion with the result that it is difficult to make the overall electromagnetic system more compact.

It is an object of the present invention to provide a polarized electromagnet and a polarized electromagnetic relay of small overall dimensions, uncomplicated structure and high stability with respect to performance and armature movement.

In view of this object, the polarized electromagnetic relay of the present invention comprises a generally E-shaped member including a pair of outer legs, a magnetically active intermediate leg between the outer legs, and a base portion interconnecting these three legs, and a generally U-shaped member including a pair of legs interconnected by a magnetically active base portion, one of the magnetically active leg and base portion carrying a coil and the other including a permanent magnet, the U-shaped member being positioned so that each of its legs extends between, and substantially parallel to, the intermediate leg and a respective one of the outer legs of the E-shaped member, and the members being movable relatively to each other in a direction transverse to the direction along which the legs extend.

The electromagnet of this type does not require any space such as taken by the hinge or bearing portion of a conventional electromagnet so that its dimensions, particularly the thickness of the electromagnet, can be reduced.

In a preferred embodiment, the E-shaped member is a stationary yoke having the coil wound about its intermediate leg, and two U-shaped movable armatures each including a permanent magnet as the magnetically active base portion are provided, one of the armatures being positioned at each end of the intermediate yoke leg. An actuating force, such as for driving relay contacts, are thus available at both ends of the electromagnetic system, thereby achieving further compactness of the overall arrangement. Depending on whether the permanent magnets of the two armatures are magnetized in the same or opposite direction, the two armatures can be made to move in parallel or anti-parallel fashion by energizing the common coil.

In another preferred embodiment, the outer legs of the E-shaped member are provided with guide slots and the legs of the U-shaped member are provided with portions projecting outwardly in opposite directions and slidably engaging the guide slots for guiding the respective movable member. The two members are thus restricted by inexpensive means to move linearly with respect to each other. The positions of the projecting portions, which are preferably used for driving movable relay contacts, thus become accurately reproducible, and a polarized electromagnetic relay may be achieved which exhibits small variation in its movement and opening characteristics.

In a further preferred embodiment, the element carrying the coil is stationary and the other element forms an armature movable between a rest position taken when the coil is not energized, and an actuated position taken when the coil is energized, wherein the armature is resiliently biased away from the actuated position, and wherein the magnetic resistances of the magnetic circuits including the permanent magnet in the rest and actuated positions of the armature are different so that the armature is returned to, and held in, its rest position when the coil is not energized. A monostable permanent magnetic system may thus be achieved by an inexpensive modification of the basic arrangement of the invention, which is again particularly useful for electromagnetic relays requiring such monostable behaviour.

Figure 2:
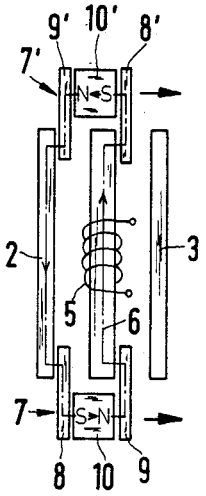
Figure 3:
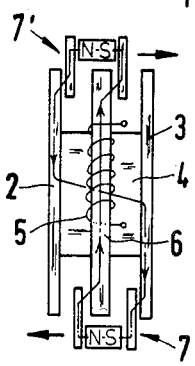
Figure 4:
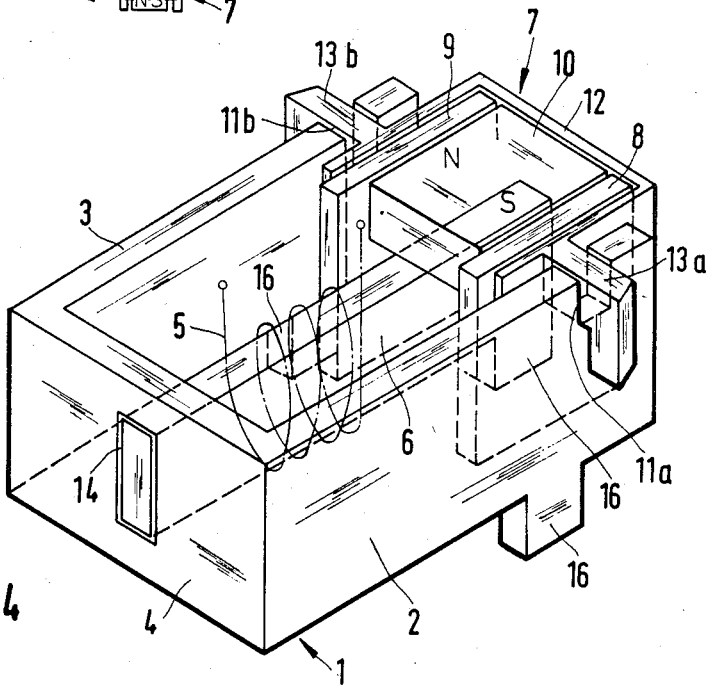
Figure 5:
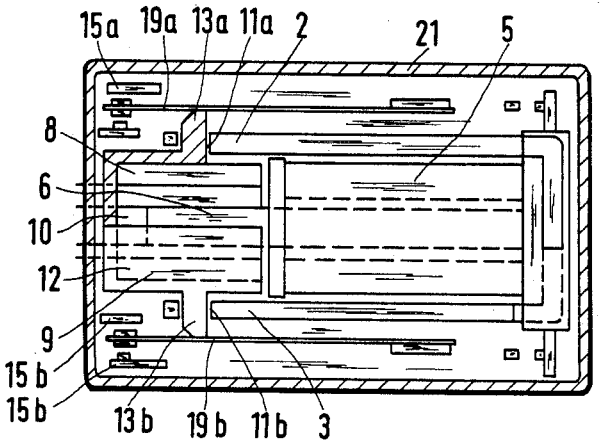
Figure 6:
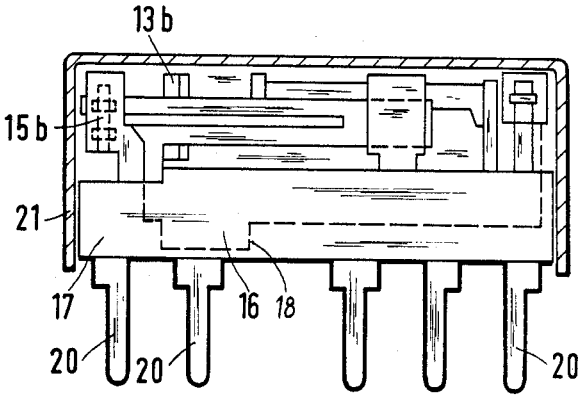
Figure 7:
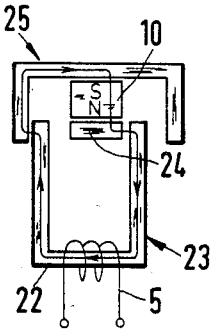
Figure 8A:
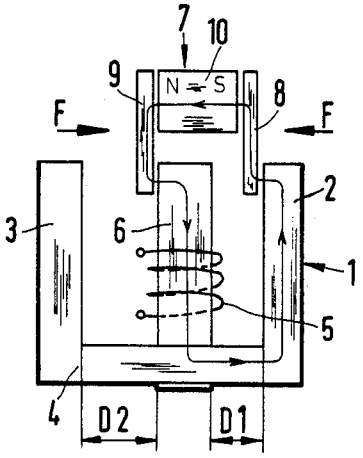
Figure 8B:
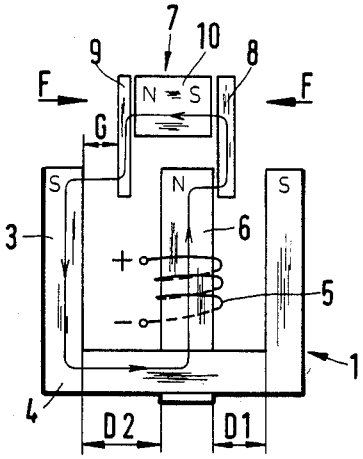
Figure 14:
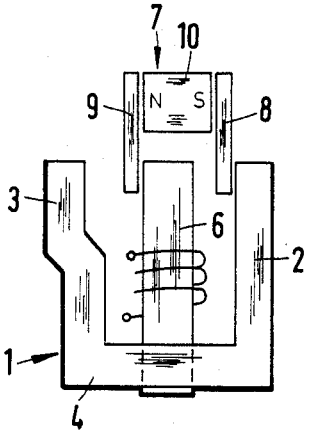
Figure 15:
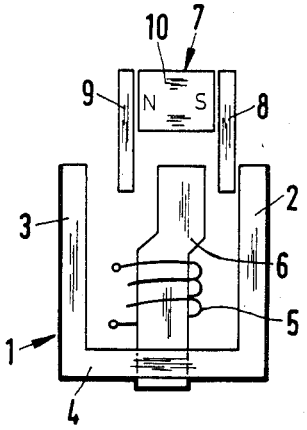
Figure 16:
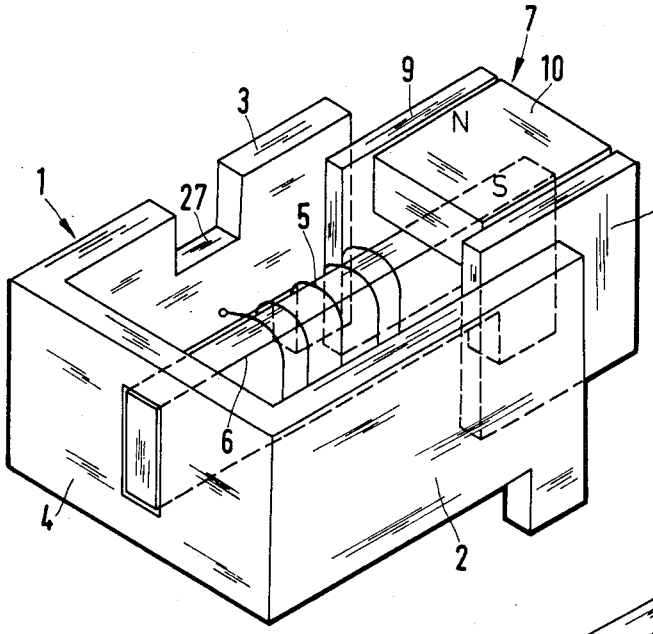
Figure 17:
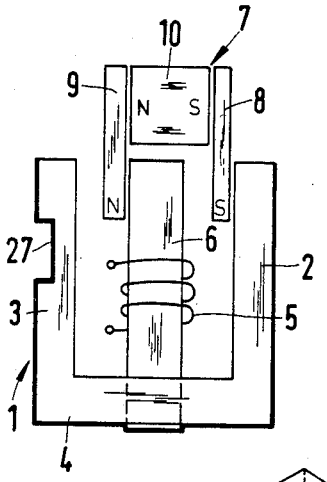
Figure 18:
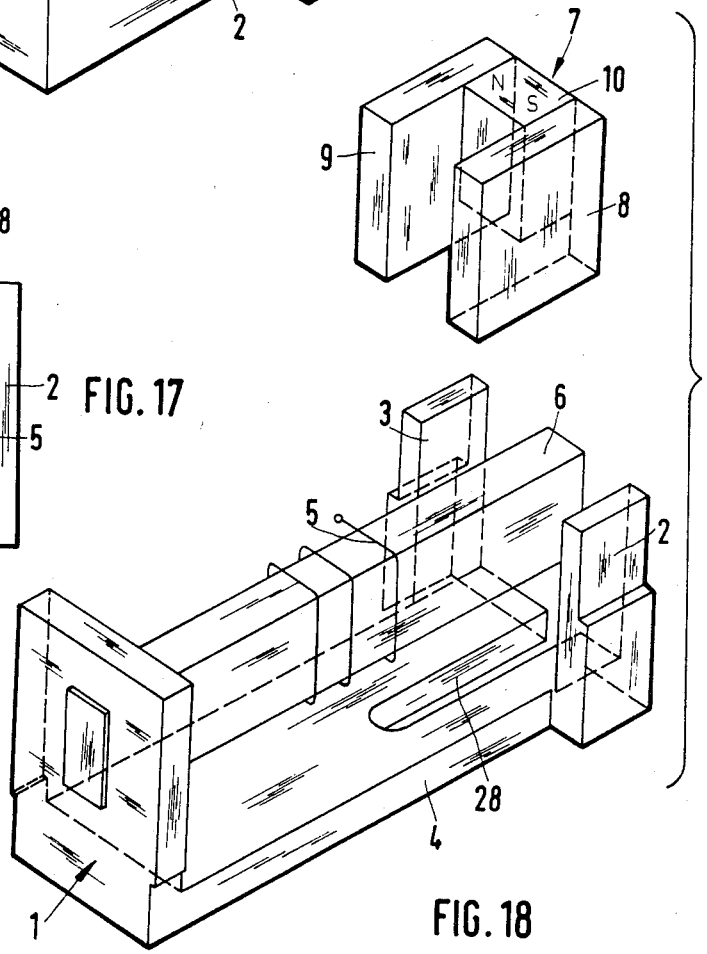

Embodiments of the invention will now be described in more detail by referring to the drawings, in which:

FIG. 1 is a perspective view of a polarized electromagnet,

FIGS. 2 and 3 are top views of slightly modified versions of the electromagnet of FIG. 1, used for explaining various modes of operation, FIG. 4 is a perspective view of a polarized electromagnetic system in accordance with another embodiment of the invention, FIGS. 5 and 6 are longitudinal cross-sectional views of a relay using the electromagnetic system of FIG. 4, FIG. 7 is a diagrammatic top view of a polarized electromagnet exemplifying another embodiment of the invention, FIGS. 8*a* and 8*b* are diagrammatic views for explaining the operation of a monostable version of the electromagnetic system of the present invention, and FIGS. 9 to 15 and 17 are diagrammatic top views, and FIGS. 16 and 18 perspective views of further embodiments of a monostable polarized electromagnetic system.

Referring to FIG. 1, a yoke 1 is shown which includes two pairs of opposed plates 2, 3 and 2', 3' of magnetizable material provided at either end of a base portion 4. A coil 5 is wound about an intermediate plate 6 which extends along the base portion 4 between the plates 2, 3 and 2', 3'. The intermediate plate 6 is magnetically isolated from the base portion 4 and the plates 2, 3 and 2', 3'. The plates 2, 3, the base 4 and the intermediate plate 6 together form a member of generally E-shaped cross-section.

An armature 7 consisting of a pair of pole plates 8, 9 and a permanent magnet 10 interposed between the pole plates 8 and 9 is movable relatively to the yoke 1 in a direction perpendicular to the longitudinal extension thereof. The armature 7 is so disposed that the pole plates 8 and 9 are located between the intermediate plate 6 and the respective outer plates 2, 3 of the yoke. The armature 7 forms an element of generally U-shaped cross-section.

A similar U-shaped armature 7' including a pair of pole plates 8', 9' and a permanent magnet 10' is similarly located at the other end of the yoke 1.

In FIG. 2, it is assumed that the two permanent magnets 10, 10' are magnetized in anti-parallel fashion. In the condition shown in FIG. 2, the two armatures 7, 7' are held in their left-hand position by the magnetic fluxes produced by the permanent magnets 10, 10'. When the coil 5 is energized by direct current in such a direction that the intermediate plate 6 exhibits a North pole at its lower end and a South pole at its upper end, both armatures 7, 7' will be moved in the direction of the arrows by attraction forces created between the pole plates 9, 9' and the ends of the magnetized intermediate plate 6. The embodiment of FIG. 2 is different from that of FIG. 1 in that continuous plates 2, 3 are provided at both sides of the intermediate plate 6.

In the embodiment of FIG. 3, the permanent magnets 10, 10' of the movable armatures 7, 7' are magnetized in the same direction, which is achieved for instance by turning one of the two armatures 180° about its longitudinal axis. In the condition shown in FIG. 3, the two armatures are held in their positions by a magnetic flux indicated in phantom lines similar to FIG. 2. When the coil 5 in FIG. 3 is energized so as to switch-over the electromagnet, the lower armature 7 moves to the left and the upper armature 7' moves to the right as indicated by the arrows.

In the embodiment of FIG. 4, the armature 7 consists of a permanent magnet 10, pole plates 8 and 9 fitted to either end of the direction of magnetization of the permanent magnet 10, and a substantially U-shaped molded resin member 12 provided with projecting portions 13*a*, 13*b*. The resin member 12 is fitted around the permanent magnet 10 and the pole plates 8, 9, and the projecting portions 13*a*, 13*b* may be molded integrally with the resin member 12 or may be made of other non-magnetic material and otherwise rigidly connected to the member 12.

The generally E-shaped yoke 1 is formed by press-fitting one end of an intermediate plate 6 into an opening 14 of the yoke base portion 4. As in the previous embodiments, the coil 5 is wound about the intermediate plate 6.

Guide slots 11*a*, 11*b* are provided in the outer plates 2, 3 of the yoke 1 and are slidably engaged by the projecting portions 13*a*, 13*b*, respectively, of the movable armature 7. The portions 13*a*, 13*b* project from the resin member 12 along the same axis to opposite sides thereof, and accordingly the guide slots 11*a*, 11*b* are aligned with each other. When the coil 5 is energized, the armature 7 can slide smoothly in a direction parallel to the direction of magnetization of the permanent magnet 10.

FIGS. 5 and 6 illustrate an electromagnetic relay using the electromagnet system of FIG. 4. Foot portions 16 projecting downwardly from the lower surfaces at the ends of the three yoke plates 2, 3 and 6 are fitted into corresponding holes 18 of a relay body 17. By attaching the E-yoke 1 to the body 17 in this manner, it is held securely and with high dimensional accuracy with respect to the mutual spacings between the plates 2, 3 and 6 of the yoke 1.

In FIGS. 5 and 6, the projecting portions 13*a*, 13*b* are shown to serve as actuating portions engaging movable contact springs 19*a*, 19*b*, respectively, which cooperate with fixed contacts 15*a*, 15*b*, respectively. Contact and coil terminals 20 extend through the relay body 17, and a cover 21 cooperates with the body 17 to seal the electromagnet and contact system against the environment.

In FIG. 5, the relay is shown in a neutral central position which it will assume in normal operation only during change-over from one stable switching position to the other. In either of these stable positions, the armature 7 is held by the respective magnetic flux produced by the permanent magnet 10. When the coil 5 is energized by direct current of proper polarity, the armature 7 will be switched to the other position, correspondingly entraining both contact springs 19*a*, 19*b*, and when the coil is thereafter deenergized, the permanent magnet 10 will then cause this other switching position to be stably maintained, until the coil 5 is energized in the opposite direction.

Due to the guiding of the projecting portions 13*a*, 13*b* extending from the resin member 12 by the guide slots 11*a*, 11*b* provided in the outer plates 2, 3 of the yoke 1, the armature 7 in the embodiment of FIGS. 4 to 6 is driven smoothly with reduced shake, the positions of the projecting portions 13*a*, 13*b* which actuate the contact springs are accurately reproducible, and variations in the movement and opening characteristics of the relay are extremely small.

FIG. 7 illustrates a polarized magnetic system which differs from that shown in FIG. 4 in that the functions of the E-shaped and U-shaped members are inverted. In the system of FIG. 7, the coil 5 is wound about the base portion 22 of a generally U-shaped yoke 23, and the permanent magnet 10 is inserted into the intermediate leg 24 of a generally E-shaped armature 25. In the condition shown in FIG. 7, the armature 25 is held in its position by the magnetic flux produced by the permanent magnet 10 and illustrated in FIG. 7 by the arrowed line. When the coil 5 is energized by direct current of a polarity which magnetizes the U-shaped yoke in a direction opposite to the arrowed line, the armature 25 will be moved to the left and thereafter held stably in that position, again by the remaining permanent magnetic flux.

The embodiments of FIGS. 8*a* and 8*b* is a modification of the polarized electromagnet shown in FIG. 4 in that the intermediate plate 6 of the E-shaped yoke 1 is offset from its central position to provide a smaller spacing D1 between the intermediate plate 6 and the outer plate 2, and a comparatively larger spacing D2 between the intermediate plate 6 and the other outer plate 3. Monostable switching behaviour of the electromagnetic system is thereby achieved.

In the position shown in FIG. 8*a*, the armature 7 is maintained by the permanent magnetic flux passing from the North pole of the permanent magnet 10 through the pole plate 9 of the armature 7, the intermediate plate 6, part of the base portion 4, the outer plate 2 of the E-yoke 1, the other pole plate 8 of the armature 7 to the South pole of the permanent magnet 10. In the position shown in FIG. 8*a*, small air gaps exist between the pole plate 9 and the intermediate yoke plate 6 as well as between the pole plate 8 and the outer yoke plate 2.

When the coil 5 is energized to magnetize the yoke 1 in such a direction that a North pole is created at the upper end of the intermediate plate 6, the armature 7 will be switched to the position shown in FIG. 8*b*, in which the magnetic flux produced by the coil 5 and the permanent magnet 10 has to cross a comparatively large air gap G existing between the pole plate 9 and the outer yoke plate 3. When the coil 5 is thereafter deenergized, the remaining magnetic flux produced by the permanent magnet 10 will be considerably smaller than in the position shown in FIG. 8*a*, due to the increase in magnetic resistance caused by the air gap G.

Assuming the electromagnetic system of FIGS. 8*a* and 8*b* is used in a relay as shown in FIGS. 5 and 6, the contact springs 19*a*, 19*b* will exert forces F on both sides of the armature which together create a tendency to drive the armature away from its actuated position towards the neutral position assumed in FIG. 5. In the embodiment of FIGS. 8*a* and 8*b*, the strength of the permanent magnet 10 and the air gap G can be dimensioned so that the resulting force of the contact springs is larger than the latching force of the permanent magnet in the position shown in FIG. 8*b* and smaller than the latching force in the position shown in FIG. 8*a*. Accordingly, when the coil 5 is deenergized, the armature 7 will be returned from its actuated position shown in FIG. 8*b* into its rest position shown in FIG. 8*a*. Monostable operation of the electromagnetic system is thus achieved.

FIGS. 9 to 18 illustrate other possibilities of providing an asymmetry in the magnetic resistances of the magnetic circuits through which the permanent magnetic flux flows in the two positions of the armature, to achieve monostable operation.

Figure 9:
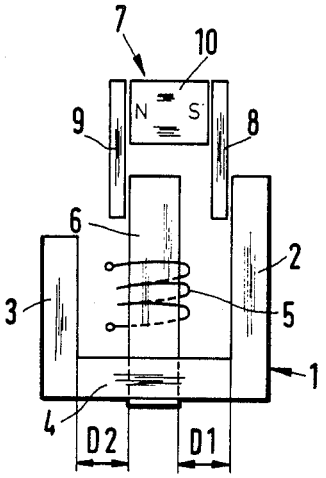

In FIG. 9, the intermediate plate 6 of the E-shaped yoke 1 is centrally located between the outer yoke plates 2 and 3, i.e. the spacings D1 and D2 between the intermediate plate 6 and the outer plates 2, 3 are equal, but the yoke plate 3 is reduced in length.

Figure 10:
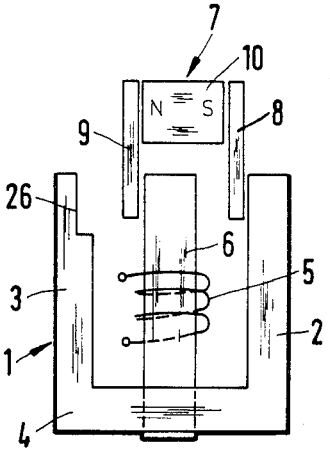
Figure 11:
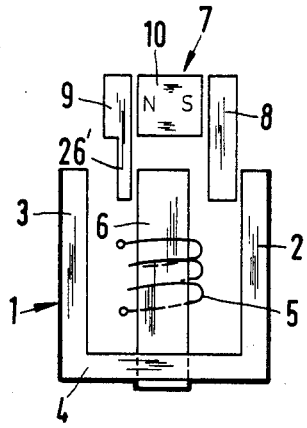
Figure 12:
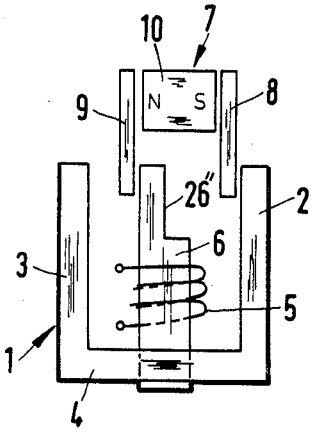

In the embodiment of FIG. 10, the intermediate plate 6 is again disposed centrally, but the yoke plate 3 is provided with a step 26 at its end thereby creating a larger air gap with respect to the pole plate 9 of the armature 7. In FIGS. 11 and 12, a similar step 26 is provided at the end of the pole plate 9 and of the intermediate yoke plate 6, respectively.

Figure 13:
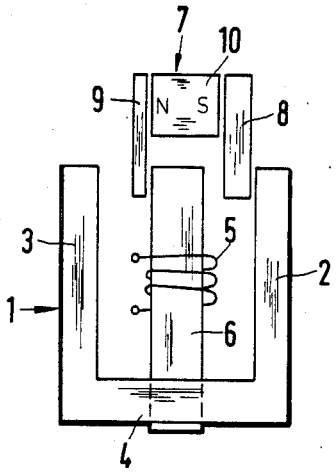

In FIG. 13, the pole plates 8 and 9 are of different thicknesses, thereby again causing a larger air gap when the armature 7 is in the actuated, left-hand position.

In FIGS. 14 and 15, the outer yoke plate 3 and, respectively, the intermediate yoke plate 6 is bent to produce different spacings between the active ends of the three yoke plates and the pole plates of the armature. In addition to the embodiments of FIGS. 14 and 15, the same monostable characteristic would be achieved by bending the right-hand outer yoke plate 2 inwardly.

In FIGS. 16 and 17, the yoke plate 3 is provided with a notch 27 cut from the upper side or outer side of the plate. In both cases, the cross-sectional area of the plate 3 is reduced, thereby increasing the magnetic resistance in this leg of the yoke.

In FIG. 18, a slot 28 is cut into the base portion 4 of the yoke 1 thereby rendering the magnetic resistance of the magnetic circuit including the yoke plate 2 greater than the magnetic resistance of the magnetic circuit including the yoke plate 3.

We claim:

1. A polarized electromagnet comprising a generally E-shaped yoke including a pair of outer legs, a magnetically active intermediate leg disposed between the outer legs and carrying a coil, and a base portion interconnecting these three legs, a generally U-shaped armature including a pair of legs interconnected by a magnetically active base portion including a permanent magnet, said armature being positioned so that each of its legs extends between, and substantially parallel to, the intermediate leg and a respective one of the outer legs of said yoke, said armature being movable relative to said yoke in a direction transverse to the direction along which all of said legs extend, and wherein the outer legs of said yoke are provided with guide slots and said armature is inserted in a member of non-magnetic material provided with portions projecting outwardly in opposite directions and slidably engaging said guide slots.

2. The electromagnet of claim 1, wherein the armature is movable between a rest position taken when the coil is not energized, and an actuated position taken when the coil is energized, wherein said armature is resiliently biased away from said actuated position, and wherein the magnetic resistances of the magnetic circuits including said permanent magnet in the rest and actuating positions of the armature are different so that the armature is returned to, and held in, its rest position when the coil is not energized.

3. The electromagnet of claim 2, wherein said intermediate leg of said yoke is differently spaced from the two outer legs thereof.

4. The electromagnet of claim 3, wherein said different spacing is achieved by a step formed in at least one of the legs of said members.

5. The electromagnet of claim 3, wherein said different spacing is achieved by a bend formed in at least one of the legs of said members.

6. The electromagnet of claim 2, wherein the outer legs of said yoke have different lengths.

7. The electromagnet of claim 2, wherein the legs of said armature have different thicknesses.

8. The electromagnet of claim 2, wherein one of the outer legs of said yoke has a portion of reduced cross-section.

9. The electromagnet of claim 2, wherein an asymmetrical slot is formed in the base portion of said yoke.

10. A polarized electromagnetic relay comprising at least one fixed contact and at least one movable contact cooperating with said fixed contact, a generally E-shaped yoke including a pair of outer legs, an intermediate leg having a coil wound thereabout, and a base portion interconnecting these three legs, a generally U-shaped armature including a pair of pole plates attached to the ends of a permanent magnet, said armature being positioned so that each of its pole plates extends between, and substantially parallel to, the intermediate leg and a respective one of said outer legs of said yoke, said armature being movable relative to said yoke transversely of the direction along which said legs and pole plates extend, and actuating said movable contact, and wherein said outer yoke legs are provided with guide slots and said armature is inserted in a member of non-magnetic material provided with portions projecting outwardly in opposite directions, extending through said guide slots, and engaging said at least one movable contact.

11. The relay of claim 10, wherein said armature is movable between a rest position taken when said coil is not energized, and an actuated position taken when said coil is energized, wherein said armature is resiliently biased away from said actuated position by a spring forming said movable contact, and wherein the magnetic resistances of the magnetic circuits including said permanent magnet in the rest and actuated positions of the armature are different so that the armature is returned to, and held in, its rest position when the coil is not energized.

* * * * *